United States Patent [19]

Bay

[11] Patent Number: 4,705,496

[45] Date of Patent: Nov. 10, 1987

[54] ARRANGEMENT INCLUDING AN INVERTER FOR FEEDING SHEETS OF PAPER INTO AN AUTOMATIC ZIGZAG FOLDING MACHINE

[76] Inventor: Otto Bay, Luzernstrasse 45, CH-4553 Subingen, Switzerland

[21] Appl. No.: 6,890

[22] Filed: Mar. 20, 1987

Related U.S. Application Data

[62] Division of Ser. No. 785,060, Oct. 4, 1985, abandoned.

[30] Foreign Application Priority Data

Oct. 27, 1984 [DE] Fed. Rep. of Germany ..... 3439423

[51] Int. Cl.[4] ..... B31B 1/88

[52] U.S. Cl. ..... 493/320; 493/416; 493/433; 271/186; 271/902

[58] Field of Search ..... 493/10–13, 493/320, 416, 430, 433, 440, 451; 270/39; 271/186, 225, 902

[56] References Cited

U.S. PATENT DOCUMENTS 3,052,464 9/1962 Funk ..... 493/10

3,961,781 6/1976 Funk ..... 493/13

*Primary Examiner*—Frederick R. Schmidt

*Assistant Examiner*—Robert Showalter

*Attorney, Agent, or Firm*—Frishauf, Holtz, Goodman & Woodward

[57] ABSTRACT

An arrangement for automatically feeding sheets of paper of varying rectangular formats into an automatic zigzag folding machine allows sheets to be processed whose lower edge of the printed side is on the opposite side. Processing can take place in the same machines together with regular sheets, and the results are the same. For this purpose the sheets are inverted about an axis at a right angle to the direction of advancement by use of the feeding channel, and the sequence of the folding machine is changed to work in reverse order.

5 Claims, 4 Drawing Figures

ARRANGEMENT INCLUDING AN INVERTER FOR FEEDING SHEETS OF PAPER INTO AN AUTOMATIC ZIGZAG FOLDING MACHINE

This is a division of application Ser. No. 785,060, filed Oct. 4, 1985 and now abandoned.

The invention relates to an arrangement for automatically feeding sheets of paper of varying rectangular formats and with an identifying title box or information field on the printed side into an automatic machine for zigzag folding in accordance with an adjustable folding sequence.

BACKGROUND

The zigzag folding of sheets of paper is a technique that is frequently used after printing or reproducing large-format plans, technical drawings, blueprints, etc., in order to fold such sheets into a standard size that makes it possible to file them in a box file in such a way that they can be easily removed and/or unfolded. The zigzag folding of the sheet and if need be the lateral folding of the resulting zigzag-folded set has to be carried out in such a way that each information field situated in the bottom right-hand corner of the sheet for indicating the plan designation or drawing reference number appears on top of each sheet, on its uppermost fold, and that the lateral sheet edge adjacent to this information field protrudes sideways at the bottom fold of the zigzag-folded set, wide enough for a binding-margin.

To achieve this result through zigzag-folding sheets of large formats (larger than DIN A 4, i.e., larger than approximately 8"×11½"), the sheet that conventionally was spread out on the feeding channel with its printed side up has heretofore been fed into the zigzag folding apparatus with the binding-margin as the leading edge. Thus, the information field is situated at the back corner of the sheet, seen on the left in relation to a vertically illustrated feeding axis, and feeding or advance takes place along the axial direction of the bottom edge of the sheet or printed image, which edge connects between this sheet corner and the above named forward sheet edge. The sheet's bottom edge slides along a guide bar arranged at the left edge of the feeding channel. The generally desired reinforcement of the sheet margin and its perforation is carried out immediately before the sheet enters the folding apparatus.

The known zigzag folding process is electronically controlled in such a way that the bottom panel of the resulting zigzag-folded set is laid out with its printed side up as it leaves the folding apparatus, and each subsequent panel is laid onto the previous one in such a way that the uppermost panel with the information field is laid out printed side up in the same manner as the bottom panel. Thus the zigzag-folded set has at least two or a higher even number of fold edges, depending on the size of the sheet, running parallel to the binding-margin; the distance between these fold edges and the margin are determined automatically through conventional size-scanning of the sheet with sensors arranged within the feeding web and by a computer that controls the folding process accordingly and thus adjusts and determines the folding sequence.

If the printing or reproducing apparatus automatically delivers sheets of varying sizes with their bottom edges, abutting the guide bar arranged at the left margin of the feeding channel, the continued advance along this bar, creation of the binding-margin, and the zigzag-folding process can also become fully automatic.

However, if the sheet supply in the printing or reproduction apparatus is arranged separately by format in different stacks or rolls in such a way that each sheet is delivered automatically with its lower printed-image edge abutting at a guide bar arranged at the right-hand margin of the feeder web, the information field is situated in the right-hand forward corner of the sheet, and the sheet edge intended for the binding-margin is situated at the rear edge of the sheet. In this case the above described zigzag folding system would not result in a folded set meeting the aforementioned requirements, even if the computer were to be reprogrammed according to the altered initial position of the sheet. The information field would be on the top side of the bottom panel and would thus face inside the zigzag-folded set, while the binding-margin would be on the uppermost panel.

THE INVENTION

It is an object to provide an arrangement which permits utilization of the aforementioned zigzag folding process, even in cases where the sheets arrive on the feeding web of the folding machine with the image edge of the printed side reversed from where it would be in conventional cases.

Briefly, for sheets whose lower image edge is in a reversed position, the feeder channel has across its entire width an inverting-curve that runs in the advance direction and causes the sheet in the advance to be turned over downward about an axis at a right angle to the advance direction, and the folding sequence of the folding machine is adjusted to work in reverse order. According to the invention an inverting-curve is provided for in the feeding channel for advancing the sheet that is spread out for zigzag folding. This allows the sheet that initially has the printed side up to be inverted while advancing and to be fed into the folding apparatus in that new attitude. If in addition the computer program for the fold distances and for positioning the folds in relation to the forward edge of the sheet is altered in comparison with the known folding process because the sheet now arrives in the folding apparatus with the information field first, the zigzag folding of the sheet can be performed in the conventional manner without further design changes. It is only necessary to arrange the panels of the zigzag-folded set in reverse order until the new bottom panel and the uppermost fold panel both point with their printed sides down, while the uppermost fold has a binding-margin that protrudes sideways from the zigzag-folded set. If this folded set is turned upward with the printed side of the lowest panel facing up, it corresponds precisely with a set produced in the conventional manner.

Preferably the inverting-curve of the feeding channel has a reversing angle of at least approximately 180°.

It is particularly advantageous if the inverting-curve of the feeding channel leads from a higher to a lower web level and if the folding apparatus is arranged below the upper level of the feeding channel, since this considerably shortens the space required by the entire folding line in comparison with a folding line without an inverting-curve, e.g. by considerably more than one third.

DRAWINGS

DETAILED DESCRIPTION

Figure 1:
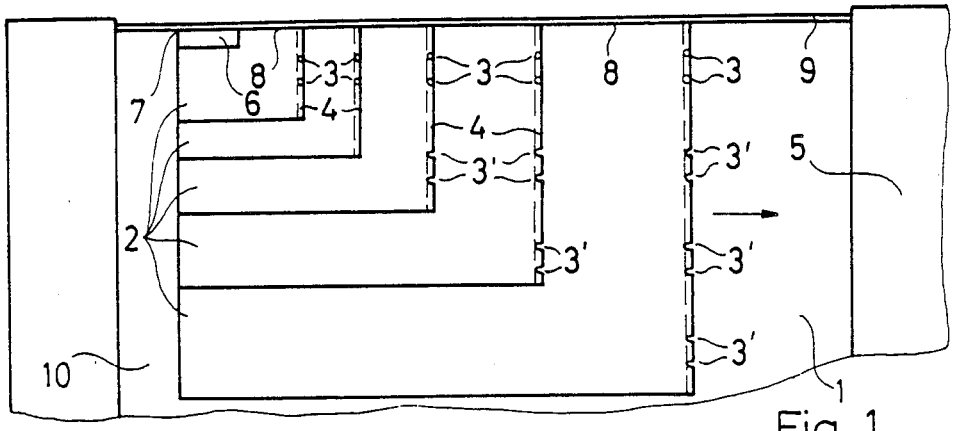
FIG. 1 shows the known manner of feeding sheets into a zigzag folding machine.

As shown in FIG. 1, sheets of paper 2 that are turned printed side up and spread out on a feeding track or channel 1 are fed into a zigzag folding apparatus 5 with the sheet edge 4 intended for a binding-margin 3 advancing first. Information field 6 is situated in the rear left-hand corner 7 seen in advance direction, and the advance takes place along the axial direction of bottom sheet edge 8, connecting this sheet corner 7 and leading sheet edge 4. Sheet edge 8 of the sheets slides along guide bar 9 arranged at feeding channel 1. The usually desired reinforcement of sheet edge 4 and binding-margin 3 and, if need be, of perforation slots 3' is accomplished on sheet 2 immediately before it enters folding apparatus 5, by means of known cutting or punching tools not described here in detail.

The known zigzag folding process, whose results are standardized by regulations and which is not described here in detail, is electronically controlled in such a manner that the lowest panel of the resulting zigzag-folded set is placed with its printed side up and each subsequent fold is placed onto the previous panel after leaving the folding apparatus 5. The uppermost panel with information field 6 faces up as does the lowest. Thus the zigzag-folded set has at least two or a higher even number of fold edges running parallel to the sheet edge 4, depending on the size of the sheet. The distances of these folds from the sheet edge are determined automatically through conventional size-scanning of the sheet with sensors arranged within the feeding channel and by a computer that controls the folding process accordingly.

FIG. 1 shows a printing or reproduction apparatus 10 which delivers sheets 2 of varying formats automatically with the sheet edges abutting a guide bar 9, which is arranged along the left edge of feeding channel 1. This permits performing in a fully automatic manner the steps of further advancing the sheet along the channel, perforating the sheet edge, and zigzag-folding the sheet.

Figure 2:
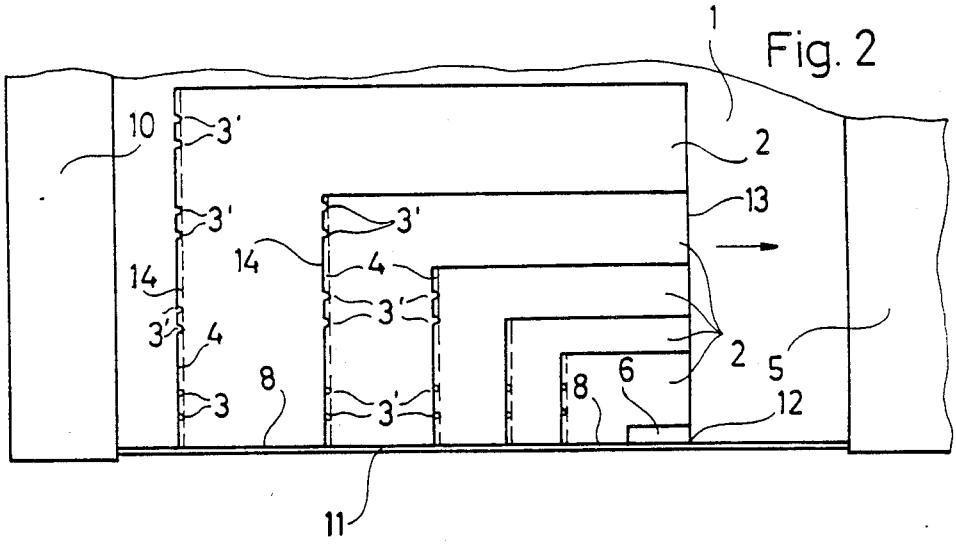
FIG. 2 shows the manner of feeding sheets whose image edge of the printed side is situated on the opposite side in comparison with FIG. 1.

However, if as shown in FIG. 2, the sheet supply in the printing or reproduction apparatus 10 is arranged separately by format in different stacks or rolls in such a way that each sheet 2 is delivered automatically with its lower printed-image edge 8 abutting guide bar 11 arranged at the right-hand margin of feeder channel 1, the information field 6 is situated in the right-hand forward corner 12 of sheet 2, and the sheet edge 4 intended for the binding-margin 3 is situated at the rear edge 14 of sheet 2. In this case, the zigzag folding system described in FIG. 1 would not result in a folded set meeting the above described requirements, even if the computer were to be reprogrammed according to the altered initial position of the sheets. Information field 6 would be on the top side of the bottom panel, while sheet edge 4 would be on the uppermost panel.

Figure 3:
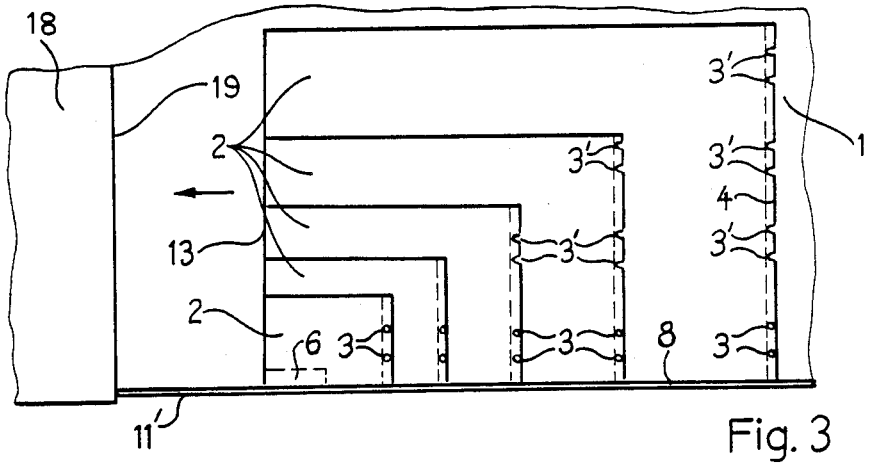
FIG. 3 shows the principle of feeding sheets according to the invention for a final phase prior to entering the zigzag folding machine.
Figure 4:
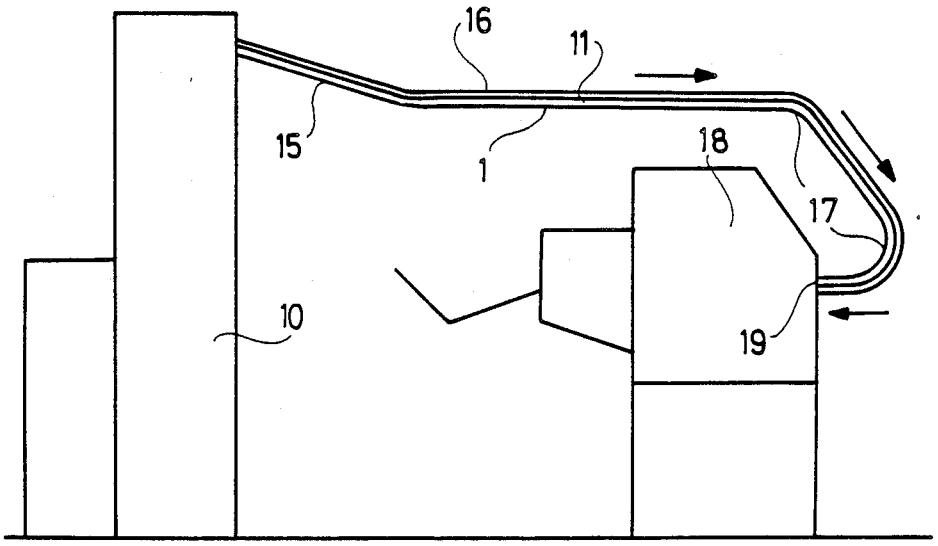
FIG. 4 shows a lateral view of the overall arrangement according to the invention.

To overcome this and to allow for the folding of sheets as described in FIG. 1 even in the case of sheets as described in FIG. 2, the arrangement described in FIGS. 3 and 4 is provided. According to FIG. 4 the sheets of variable rectangular format coming from a printing or reproduction apparatus 10 as shown in FIG. 2 are automatically delivered printed side up, one at a time, and spread out, on initial section 15 of feeding track 1 which is provided with an advance mechanism 16 for transporting the sheets in the direction of the arrow, and with a guide bar 11 arranged at the right-hand longitudinal edge, as seen from overhead by a viewer watching sheets advance upward. By means of advance mechanism 16, sheets 2 are transported in the position shown in FIG. 2, with their bottom edge 8 touching guide bar 11. To continue the process, feeding channel 1 has inverting-curve 17 running across its entire width, resulting in a reversing-angle for the sheets of at least approximately 180°, leading from a higher to a lower channel level. Following that, the zigzag folding machine 18 is arranged below the upper level of feeding web 1 and set up with its entrance side 19 pointing away from initial track section 15 and from the printing or reproduction apparatus. The sheets situated on the advance of feeding channel 1 are thus inverted downward, prior to entering zigzag folding machine 18, about an axis that is at a right angle to the feeding direction, their printed side down, so that they are moved toward zigzag folding machine 18 in a manner shown in FIG. 3.

Thus when the sheets, as shown in FIG. 3 and as shown by the direction of the arrow in FIG. 3, are turned printed side down, with the information field 6 in front and when they are advancing toward zigzag folding machine 18, and when zigzag folding machine 18 is now adjusted to reverse its folding sequence from that shown in FIG. 1, folding machine 18 produces a folded set whose lowest panel containing information field 6 now faces printed side down, as does the uppermost panel with binding-margin 6.

The folded set produced in that fashion only has to be turned over by hand or otherwise, to be placed in the same position as the folded set produced according to FIG. 1.

It goes without saying that as the folding sequence is reversed, the working direction of the cutting and punching tools is also reversed in such a way that only the rear edge of the arriving sheets is machined.

Finally it should be noted that the inverting-curve of feeding channel 1 that is shown as number 17 in FIG. 4 requires appropriate guiding and bracing devices to prevent the sheets from dropping off the guide track or from being carried from the higher level to the lower level guide track. However, such guiding and bracing devices are generally known and do not need to be shown and described in detail.

What is claimed is:

1. A method of inverting and folding each of a series of moving sheets in a combination of a known programmable zigzag folding machine (18), an inverter and a printing means (10), said sheets having printed indicia on one surface adjacent a leading edge thereof into respective packets bearing said indicia on an outward-facing panel thereof, comprising the steps of advancing each sheet from said printing means (10) with said one surface uppermost, turning each sheet upside down in said inverter by guiding it around a bend (17) having a substantially horizontal axis perpendicular to the advance of said sheet, thereby changing the direction of advance of said sheet by about 180 degrees advancing said sheet into an entrance (19) of said folding machine (18), zigzag-folding said sheet in said folding machine in a known manner, and ejecting a folded packet from said folding machine.

2. A method according to claim 1 wherein said advancing and guiding steps include transporting said sheet from an initial, high, elevation adjacent an outlet of said printing means (10) to a subsequent, lower, elevation adjacent said entrance (19) of said folding machine (18).

3. In combination with means (10) for supplying a sequence of sheets, printed on one side thereof, a programmable automatic zig-zag folding machine (5, 18) which folds a sheet into a standardized packet of folded panels in which the upper surface of a leading portion of said sheet is on an inward-facing surface of a first panel of said packet and the upper surface of a trailing portion of said sheet is on an outward-facing surface of a last panel of said packet, and an inverter (1,15,16,17) coupled to and receiving the sheets from said supplying means (10) and furnishing said sheets to the folded machine (18) while simultaneously inverting them, thereby permitting folding of a printed sheet having a sheet information field (6) printed along the upper surface, as received from said supplying means, of a leading portion thereof into a packet in which said sheet information field (6) is on an outward-facing surface of said folded packet.

4. The combination of claim 3, wherein said inverter comprises a feeding channel (1), for advancing each sheet from said supplying means (10) to said folding machine (18), said feeding channel advancing each sheet along an initial channel portion (15) adjacent to said supplying means (10), turning each sheet upside down by guiding it around a bend (17) having a substantially horizontal axis perpendicular to the advance of said sheet, thereby changing the direction of its advance by about 180°, and advancing said sheet into an entrance (19) of said folding machine (18).

5. The combination of claim 4, wherein said entrance (19) faces away from said supplying means (10) and from said initial portion (15) of said feeding channel (1).

* * * * *